US006805064B1

(12) United States Patent
Andersen

(10) Patent No.: US 6,805,064 B1
(45) Date of Patent: Oct. 19, 2004

(54) PERSONAL WATER CRAFT

(76) Inventor: Jens Andersen, P.O. Box 1327, Kailua Kona, HI (US) 96745

( * ) Notice: Subject to any disclaimer, the term of this patent is extended or adjusted under 35 U.S.C. 154(b) by 0 days.

(21) Appl. No.: 10/367,377

(22) Filed: Feb. 13, 2003

Related U.S. Application Data

(60) Provisional application No. 60/356,058, filed on Feb. 13, 2002.

(51) Int. Cl.[7] ..... B63B 35/00
(52) U.S. Cl. ..... 114/66; 441/65
(58) Field of Search ..... 114/66; 441/65, 441/74; 440/6

(56) References Cited

U.S. PATENT DOCUMENTS 4,840,592 A * 6/1989 Anderson ..... 441/135
4,946,412 A * 8/1990 Maruo et al. ..... 441/135
5,362,269 A * 11/1994 Leach ..... 441/65
5,595,133 A * 1/1997 Bullard ..... 114/66

* cited by examiner

*Primary Examiner*—Ed Swinehart
(74) *Attorney, Agent, or Firm*—John D. Gugliotta; Olen L. York, III

(57) ABSTRACT

A personal water craft is a device having a unitary hull body that includes a substantially horizontal planar deck for supporting an occupant in a pronate position and a shell integral with the deck, wherein the shell is submersible into water. A cushioned pad is affixed adjacent to the deck, thereby providing a comfortable resting position for the occupant. A transparent viewing panel is affixed to the bow end of the hull, thereby forming a window for the occupant to look through. A joystick for controlling the direction of said personal water craft is also included, wherein the joystick is electrically coupled with a battery, a motor and a propeller.

6 Claims, 6 Drawing Sheets

PERSONAL WATER CRAFT

RELATED APPLICATIONS AND DISCLOSURES

The present application claims priority from U.S. Provisional Application Ser. No. 60/356,058 filed on Feb. 13, 2002.

BACKGROUND OF THE INVENTION

1. Field of the Invention

The present invention relates generally to personal water craft, and more particularly to transparent hulled vessels.

2. Description of the Related Art

Nautical devices for exploring and/or observing aquatic activity are known and generally consist of two broad categories: devices having transparent bottoms surfaces or devices that are submersible through displacement of ballast. However, each category include several drawbacks, to which the present invention is directed at overcoming. Included among the drawbacks is the intricate mechanical and electrical sophistication of submersible devices, requiring a great number of moving parts and possessing a size that is neither economical nor accommodating of the typical family recreationist. Furthermore, the prior art discloses devices that are not configured for use and control by a person placed in a prone position.

A search of the prior art did not disclose any patents that read directly on the claims of the instant invention; however, the following references were considered related:

U.S. Pat. No. 6,302,043, issued in the name of Wippermann, discloses a viewing boat with a viewing cabin beneath the surface of the water, wherein the cabin has large viewing windows looking to the outside and forward from the vessel, with the viewing cabin being a transparent vessel;

U.S. Pat. No. 5,117,774, issued in the name of English et al., discloses an underwater viewing craft comprising a motor propelled floating portion with two hulls in a catamaran style and an elevated bridge connecting the two hulls;

U.S. Pat. No. 4,494,472, issued in the name of Rougerie, discloses a nautical craft with a generally tubular hull, flattened laterally, with a horizontal main axis and a succession of portholes on each of its longitudinal flanks;

U.S. Pat. No. 4,841,896, issued in the name of Fury, discloses a beach submarine comprising a body with two ballast tanks moveable between an upper and lower position, respectively, so that the body is positioned for diving or beach use, respectively;

U.S. Pat. No. 4,5481,148, issued in the name of Bloomfield, Ill., discloses a glass bottom boat, wherein the boat is a catamaran having a pair of laterally spaced apart longitudinally extending displacement hollow hulls with a generally horizontal connecting deck structure extending between the hulls;

U.S. Pat. No. 4,423,695, issued in the name of Rougeie, discloses a floatable and unsinkable natural craft comprising a hull with longitudinal sides, stabilization and buoyancy means and a passenger compartment;

U.S. Pat. No. 3,351,035, issued in the name of McLean, discloses a controlled undersea vessel comprising a floodable hull structure, an electromagnetic energy permeable capsule mounted to the hull structure and an electromagnetic energy means positioned within the capsule; and U.S. Pat. No. 1,786,091, issued in the name of Stiles, discloses a boat for inspection of submarine growth comprising spaced pontoons, a hull structure mounted onto the pontoons with a well formed between the pontoons, an observation window and a transverse partition member for deflecting water.

Consequently, a need has been felt for providing an apparatus and method which overcomes the problems cited above.

SUMMARY OF THE INVENTION

It is therefore an object of the present invention to provide a personal water craft device having a unitary hull with a deck, a shell, a transparent viewing panel and a means for controlling the movement and direction of the water craft.

It is another object of the present invention to provide a personal water craft device having a joystick electrically coupled with an electric source, a motor(s) and a propeller (s).

It is another object of the present invention to provide a substantially flat deck and a cushioned pad and surface for allowing a user to lie in a prone position while navigating the water craft.

It is another object of the present invention to provide a personal water craft device having a contoured surface and a cushioned pad conformed to the surface, thereby allowing a user to relax in a reclined seating position.

It is another object of the present invention to provide a contoured surface and cushioned pad that is adjustable between a substantially flat position and a reclined seating position.

Briefly described according to one embodiment of the present invention, a personal water craft device is an elongated nautical vessel having a unitary hull body, wherein the hull body has a deck integral with a shell. The deck includes a substantially flat surface for allowing pronate positioning of the user. The deck may include a cushioned pad and a contoured surface, wherein the contoured surface may have a reclined setting position. The shell may have a curvilinear or rectilinear form, while including a pair of hulls that are positioned about the lateral margins of the shell. Between the pair of hulls, at least one motor and propeller combination are affixed to the shell, wherein the motor drives the propeller and provides movement thereto. A second motor and propeller combination may be provided to provide increased power and control of the personal water craft device. A transparent viewing panel is affixed to the bow end of the water craft, adjacent to the deck, thereby allowing a user to view the water surface and below the water surface. A joystick is provided for steering the water craft. The joystick is in electrical communication with at least one battery, the motor(s) and the propeller(s).

Other objects of the present invention include providing a device that is portable, lightweight and easily serviced and maintained.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
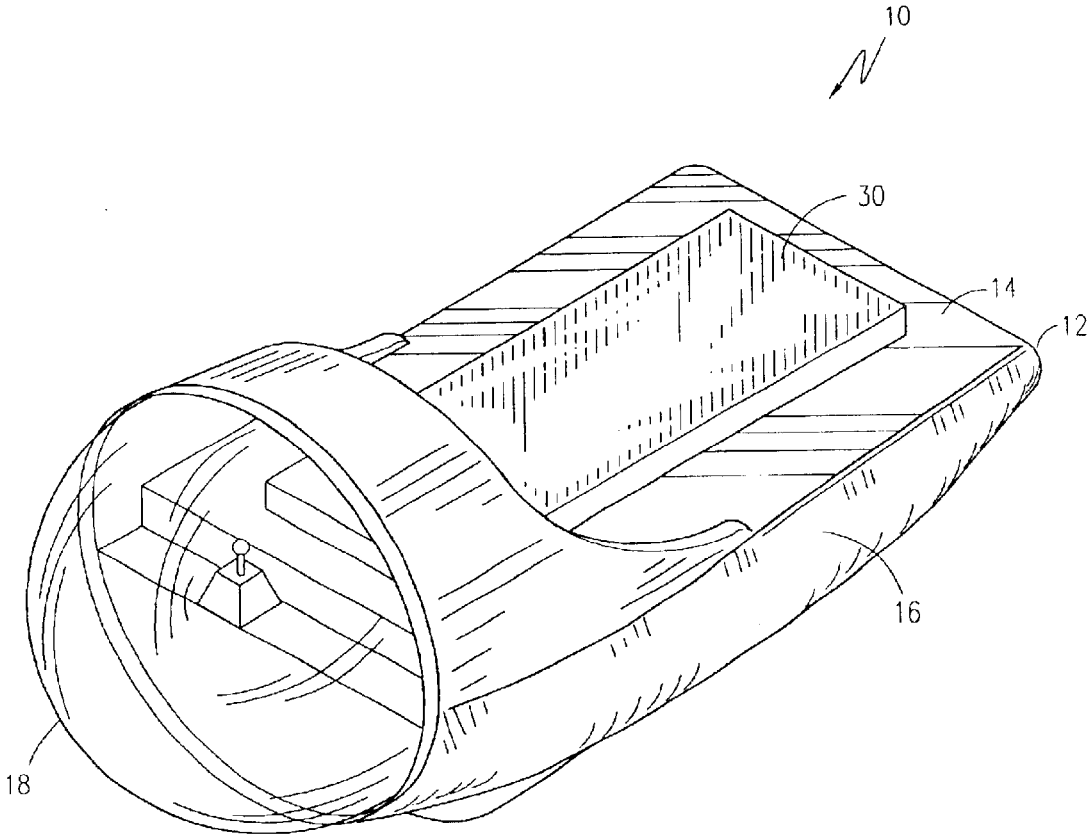
FIG. 1 is a perspective view of the preferred embodiment of a transparent hulled personal water craft according to the present invention.
Figure 2:
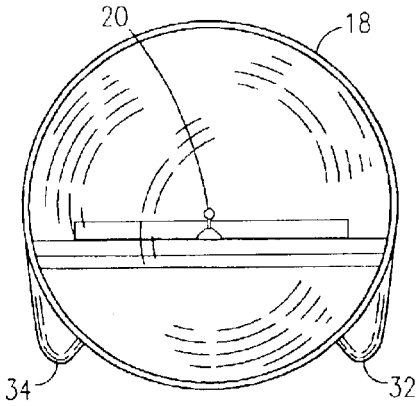
FIG. 2 is a front elevational view of the preferred embodiment.
Figure 3:
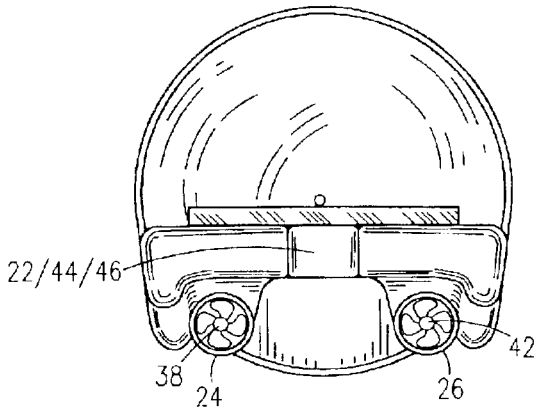
FIG. 3 is a rear elevational view of the preferred embodiment.
Figure 4:
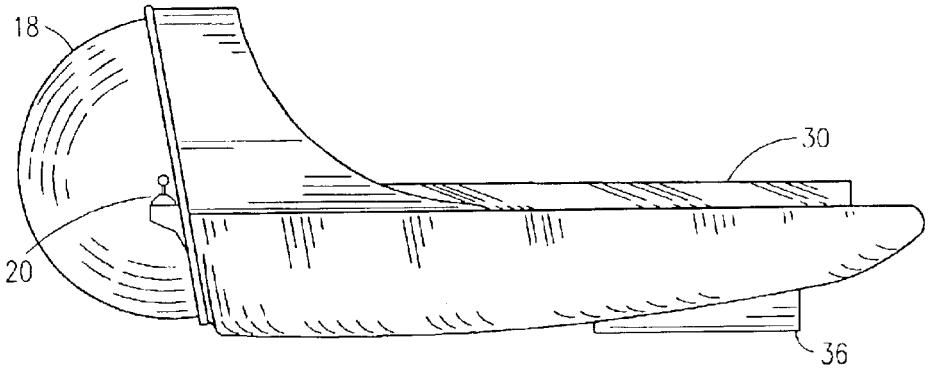
FIG. 4 is a starboard side elevational view of the preferred embodiment, the port side elevational view being a mirror image thereof.
Figure 5:
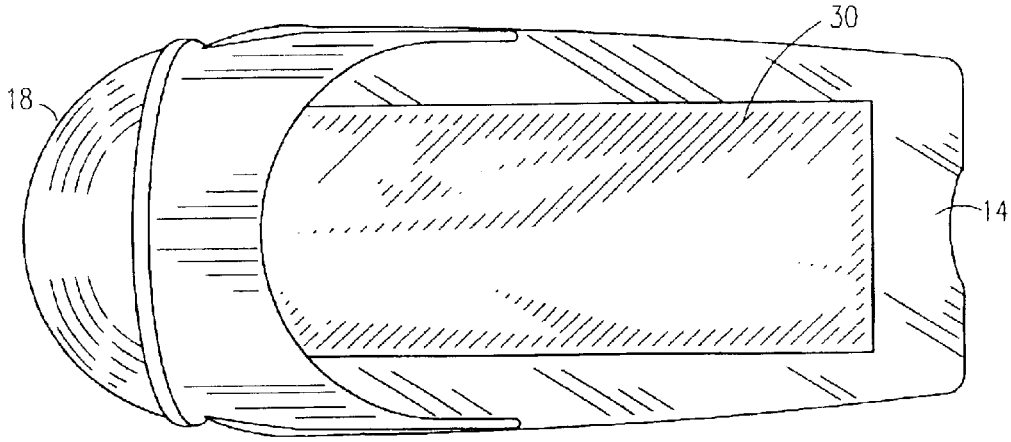
FIG. 5 is a deck side plan view of the preferred embodiment.
Figure 6:
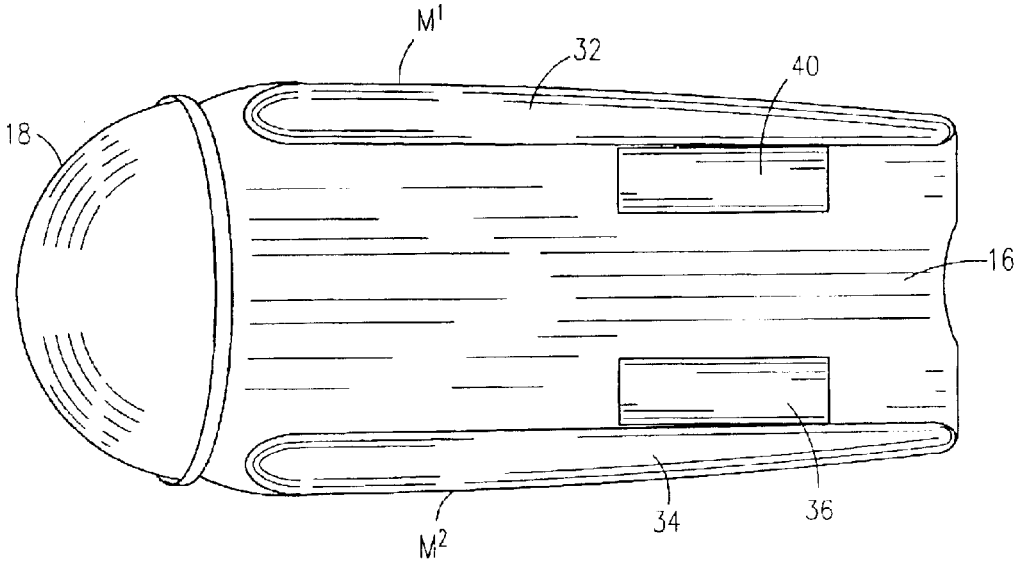
FIG. 6 is a keel side plan view of the preferred embodiment.
Figure 7:
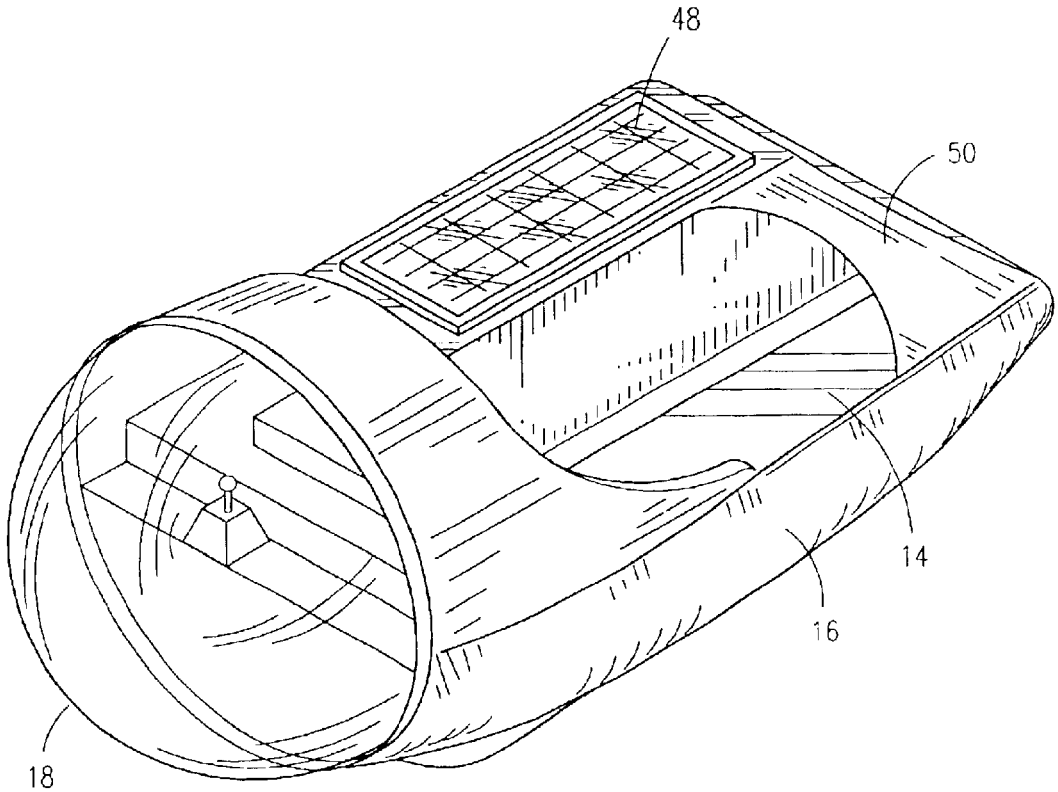
FIG. 7 is a perspective view of an alternate embodiment of the transparent hulled personal water craft, wherein the water craft includes a solar panel positioned in an upper surface.
Figure 8:
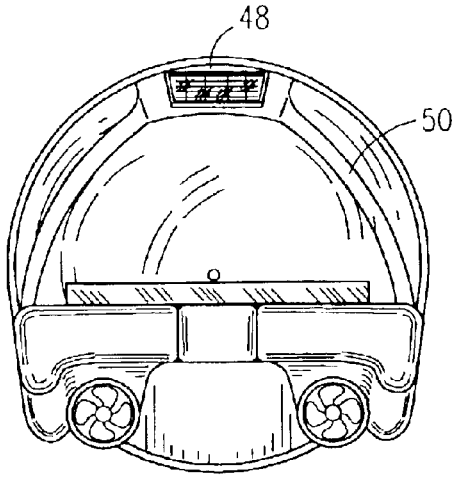
FIG. 8 is a rear elevational view of the alternate embodiment.
Figure 9:
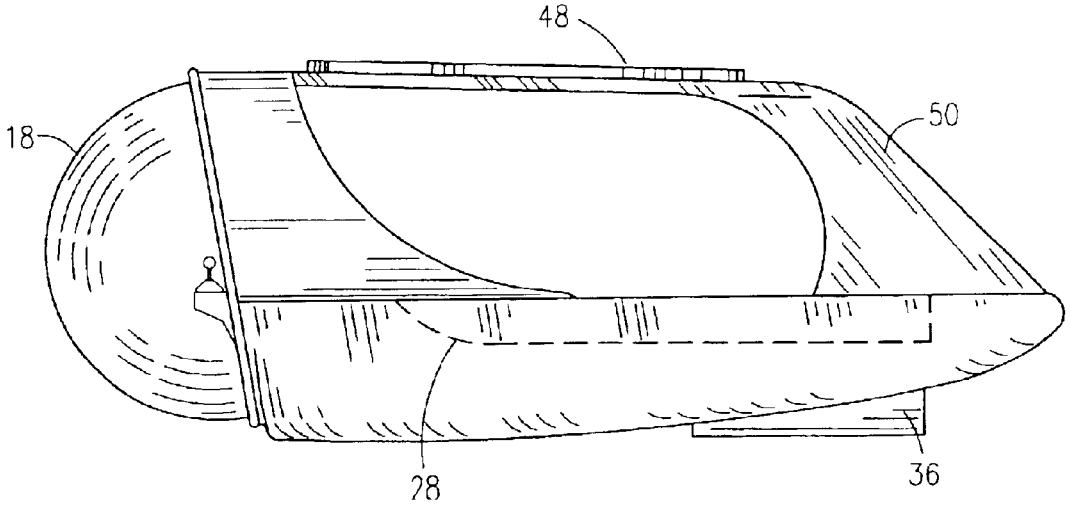
FIG. 9 is a starboard elevational view of the alternate embodiment, the port side elevational view being a mirror image thereof.
Figure 10:
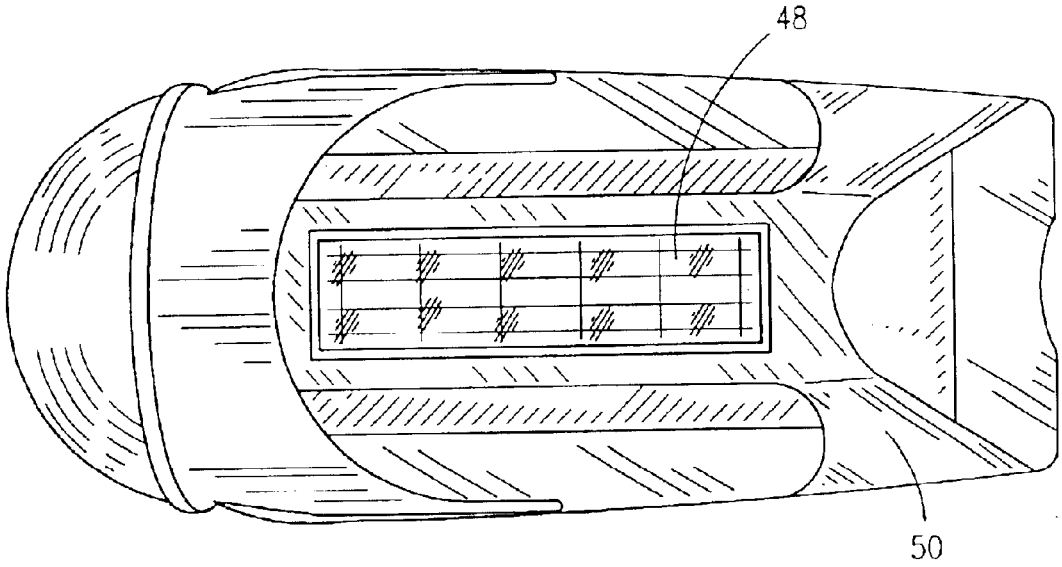
FIG. 10 is a deck side plan view of the alternate embodiment.

The best mode for carrying out the invention is presented in terms of its preferred embodiment, herein depicted within the FIGS. 1 through 10.

1. Detailed Description of the Figures

Referring now to FIG. 1 through FIG. 6, a personal water craft 10 is shown in accordance with the preferred embodiment of the present invention. The personal water craft 10 comprises a unitary hull body 12 having a deck 14 and a shell 16 integral with the deck 14. Toward the bow end of the personal water craft 10 is a transparent viewing panel 18. Adjacent to the transparent viewing panel 18 and affixed to the deck 14 is a joystick 20 operably integral with an electric source 22 and at least one driving mechanism 24. The joystick 20 provides user control of the personal water craft 10 while navigating water. The electric source 22 provides electrical current to the driving mechanism 24 and 26 and provide maneuvering power to the personal water craft 10.

The unitary hull body 12 may include a variety of shapes and sizes, including the curvilinear form of the shell 16 depicted in FIG. 1 through FIG. 10, or a rectilinear form of the shell 16 contemplated but not depicted within the figures. The deck 14 is envisioned as having a substantially horizontally planar configuration from bow to stem (front to back). However, it is also envisioned that the deck 14 may have a contoured surface 28 wherein the bow end of the deck 14 is elevated slightly above the surface 28 of the deck 14 while the remaining portion of the surface 28 descends below the surface of the deck 14 (see FIG. 9). Such a configuration provides a reclined setting position instead of a prone resting position. Optionally, the deck 14 may be adjustable between a prone position and a reclined setting position, thereby providing desirable versatility to the comfort of the user. The unitary hull body 12, including the deck 14 and the shell 16, may be manufactured from several materials, including fiberglass, plastic, corrosion resistant metal or other suitable surfaces for aquatic activity. In addition, an elongated cushioned pad 30 may be provided along the deck 14 and surface 28 for further comfort. The elongated cushioned pad 30 conforms to the contoured surface 28 of the deck 14 regardless of the configuration, such as the prone resting position or reclined setting position described above. The elongated cushioned pad 30 may be manufactured from several materials provided that the material is flexible, cushioned and resilient to withstand repeated usage. Among materials suitable for such use are foam with a vinyl covering, air, gel, or other soft materials.

Externally, the shell 16 comprises a pair of linearly elongated hulls 32 and 34 that lie parallel to the deck 14 and are positioned approximately along the lateral margins $M_1$ and $M_2$, respectively, of the unitary hull body 12. The pair of hulls 32 and 34 are integral with the shell 16, and include a starboard side hull 32 and a port side hull 34. The pair of hulls 32 and 34 provide buoyancy and directional control of the personal water craft 10 while in operation, and are configured to have a wider leading end near the bow (front) of the personal water craft 10 while tapering to a narrow trailing end near the stern (back) of the personal water craft 10. Between the pair of hulls 32 and 34 is at least one driving mechanism 24 envisioned to be a propeller housing 36, a propeller 38 and a motor(s) 50. The propeller housing 36 protects the propeller 38 from physical damage that might occur during operation or storage, and may include a solid integral housing with an aperture 44 for the propeller blades, or may have a wire cage configuration. The propeller 38 is in electrical communication with the joystick 20, a motor 50 and the electric source 22. A second driving mechanism 24 may be included, and is envisioned to be a second propeller housing 40 and a second propeller 42, also in electrical communication with the joystick 20, a motor 50 and electric source 22. In a two-propeller configuration, the first and second propellers 38 and 42 are respectively positioned adjacent to the pair of hulls 32 and 34, and toward the stem (back) of the personal water craft 10.

Internally, the shell 16 is substantially hollow so as to provide buoyancy to the personal water craft 10. Alternatively, materials or substances may be included within the internal structure of the shell 16 to enhance or enable buoyancy, such as air or cork. The shell 16 further acts as a housing for the electrical wiring and attendant components for the joystick 20, electric source 22 and the driving mechanism(s) 24, thereby protecting the electrical wiring and components from environmental elements.

The transparent viewing panel 18 may have a variety of sizes and shapes, including the bubble-shape depicted in FIG. 1 through FIG. 10. The panel 18 is manufactured from a transparent material, such as PLEXIGLAS®, glass, acrylic, hardened plastic or other transparent materials suitable for viewing. The panel 18 is affixed to the bow end of the personal water craft 10 and partially covers the deck 14. The panel 18 is partially submerged below the surface of the water so that an operator or user may peer through the panel 18 into the water and observe any aquatic activity that may be occurring.

The joystick 20 is affixed adjacent to the bow end of the deck 14 and may have a variety of configurations, provided that the joystick 20 is movable about 360° of rotation and sufficiently controls the direction of the personal water craft 10 while in operation. The joystick 20 is configured so that moving the joystick 20 forward corresponds to forward movement of the personal water craft 10, and moving the joystick 20 backward corresponds to backward movement of the personal water craft 10. Movement of the joystick 20 between the diametric positions of "forward" and "backward" correspond to rudder movement in the direction of the joystick 20 controller.

The joystick 20 and propellers 38 and 42 are provided electricity via an electric source 22, envisioned to be a battery 44 or a plurality of batteries 44. The battery(ies) 44 is/are housed within a battery storage compartment 46 formed in the deck 14 beneath the contoured surface 28 and cushioned padding 30 (if so provided). The battery(ies) 44 are electrically coupled with the electrical wiring of the joystick 20 and propellers 38 and 42. Optionally, and as seen in FIG. 7 through FIG. 10, a solar panel 48 may be provided on the top portion of a canopy 50 affixed to the deck 14. The canopy 50 is intended to cover a substantial portion of the deck 14. The solar panel 48 may either serve as the sole source of electricity or may act in concert with the battery (ies) 44.

The personal water craft 10 is intended to accommodate at least one person, but is preferably configured to accommodate at least two people lying in a prone position along the deck 14. It is anticipated that the battery(ies) 44 is removable from the battery storage compartment 46 and rechargeable in a manner commonly known in the art, such as to a separate electrical supply source. It is further anticipated that the personal water craft 10 may be available in a variety of styles and colors suitable for aquatic navigation, and may have a variety of indicia, including popular cartoon characters, sports logos, and other signifying marks.

2. Operation of the Preferred Embodiment

To use the present invention, a user may lie prone on the deck 14 and the contoured surface 28 and padding 30 (if included). The user will use the joystick 20 to directionally control the movement and course of the personal water craft 10. The user may look through the transparent viewing panel 18 to observe surface objects or impediments during travel. The user may also look through the transparent viewing panel 18 to observe aquatic activity occurring as the personal water craft 10 travels along the water surface.

The foregoing description is included to illustrate the operation of the preferred embodiment and is not meant to limit the scope of the invention. The scope of the invention is to be limited only by the following claims.

What is claimed is:

1. The personal water craft device comprising:

a unitary hull body, said hull body including a substantially horizontal planar deck for supporting an occupant in a prone position and a shell integral with said deck, said shell submersible into water, wherein said shell comprises a pair of linearly elongated hulls lying parallel to said deck, said pair of hulls respectively positioned approximately along the lateral margins of said unitary hull;

a cushioned pad, said pad affixed adjacent to said deck, thereby providing a comfortable resting position for said occupant;

a transparent viewing panel, said panel affixed to the bow end of said hull thereby forming a window for said occupant to look through; and a joystick, said joystick for controlling the direction of said personal water craft.

2. The personal water craft device of claim 1, wherein each of said pair of hulls comprise a bow end that is wider than a stem end.

3. The personal water craft device of claim 2, wherein said pair of hulls includes a starboard side hull and a port side hull.

4. The personal water craft device of claim 1 further comprising an electrically operated motor electrically coupled with said joystick, said motor in mechanical communication with a propeller, said propeller steering said craft to a desired direction.

5. The personal water craft device of claim 4 further comprising a battery for providing an electrical source to said motor.

6. The personal water craft device of claim 5, wherein said battery is housed within a battery storage compartment formed within said deck.

* * * * *